United States Patent [19]

Gebald et al.

[11] Patent Number: 4,601,133

[45] Date of Patent: Jul. 22, 1986

[54] MANIPULATOR HEAD WITH GRINDING DEVICE FOR PIPES OR PIPELINES

[75] Inventors: Georg Gebald, Kirchehrenbach; Heinz Röhrich, Nuremberg; Clemens Dippold, Bamberg; Siegfried Förner, Erlangen, all of Fed. Rep. of Germany

[73] Assignee: Kraftwerk Union Aktiengesellschaft, Mülheim, Fed. Rep. of Germany

[21] Appl. No.: 761,057

[22] Filed: Jul. 31, 1985

[30] Foreign Application Priority Data

Dec. 21, 1984 [DE] Fed. Rep. of Germany ..... 3447551

[51] Int. Cl.[4] ..... B24B 21/00

[52] U.S. Cl. ..... 51/135 R; 51/90; 51/245; 51/290; 15/104.09

[58] Field of Search ..... 51/135 R, 145, 245, 51/241 R, 241 S, 261, 170 EB, 280 P, 290, 147, 90; 409/139, 140, 143; 15/104.09, 104.12

[56] References Cited

U.S. PATENT DOCUMENTS 4,460,920 7/1984 Weber et al. ..... 358/100

*Primary Examiner*—Frederick R. Schmidt

*Assistant Examiner*—Maurina Rachuba

*Attorney, Agent, or Firm*—Herbert L. Lerner; Laurence A. Greenberg

[57] ABSTRACT

A manipulator head for the remote-controlled positioning and operation of a grinding device within a pipe, which includes two support flanges having clamping devices and guide elements for extending the manipulator head; a frame rotatably mounted in the support flanges; a grinding device, fastened to the frame, with a drive and bearing member for a grinding tool, a drive device for axially adjusting the grinding device, and a feed device for radially fine-feeding the grinding tool, a motor for rotating the frame relative to the support flanges; feed line connections of the drive devices disposed on only one of the support flanges; the frame formed of two bearing flanges clamped together by spacer sleeves and clamping bolts; a base carriage guided on the spacer sleeves to travel axially to the manipulator head; a support carriage mounted on the base carriage and carring the drive motor for the grinding tool; a base plate secured, in parallel with the support flange, to the support carriage; the grinding tool comprised of a driven abrasive belt; and a retaining clip secured to the base plate.

13 Claims, 6 Drawing Figures

MANIPULATOR HEAD WITH GRINDING DEVICE FOR PIPES OR PIPELINES

The invention relates to the field of service technology for pipe systems and is applicable to the construction of a manipulator head which is positionable by remote control alone or together with a manipulator vehicle in the interior of a pipe or a pipeline and equipped with a grinding device for processing the inner surface of the pipe or the pipeline.

A conventional manipulator head of this general type is coupled with a stepping mechanism and formed essentially of two support flanges, which are provided with radially outwardly drivable clamping devices and with radially arranged guide elements for rollingly extending the manipulator head, a frame rotatably mounted in the support flanges and rigidly connecting the two support flanges axially, and a grinding device fastened to the frame. The grinding tool per se is a grinding disc having a drive motor which is mounted in a drive and bearing member. The grinding device, furthermore, has a drive device for axially adjusting the grinding device and a feed drive for radially fine-feeding the grinding tool. Moreover, a revolving motor mounted on the one support flange is provided for rotating the frame relative to the support flanges whereas the connections for the feed lines of the various drive units are provided on the other support flange (U.S. Pat. No. 4,460,920). This heretofore-known manipulator head has a relatively low grinding power and must be controlled then in a very costly manner for pipelines which are traversible only on one side, if the circular path of the slowly rotated frame carrying the grinding device is inclined to a greater or lesser extent towards the circular path of the welded seam.

It is accordingly an object of the invention to provide a manipulator head of such construction that a grinding belt can be inserted therein to increase the grinding power and also, for pipelines traversible at one side thereof at pipe bends, such a positioning of the grinding device is assured that the grinding device, during rotation thereof about the axis of the manipulator head, describes a circular path at the periphery of the pipe and the pipeline, respectively.

With the foregoing and other objects in view, there is provided, in accordance with the invention, a manipulator head for remote-controlled positioning and operation of a grinding device within a pipe, including two support flanges having radially outwardly drivable clamping devices and radially disposed guide elements for rollingly extending the manipulator head, a frame rotatably mounted in the support flanges and rigidly connecting the two support flanges axially, a grinding device fastened to the frame, the grinding device including a grinding tool, a drive and bearing member for the grinding tool, a drive device for axially adjusting the grinding device, and a feed drive device for radially fine-feeding the grinding tool, motor means for rotating the frame relative to the support flanges, connections for feed lines of the drive devices disposed on only one of the support flanges, the frame being formed of two bearing flanges clamped together by means of spacer sleeves and clamping bolts extending through the spacer sleeves, a base carriage guided on the spacer sleeves so as to travel axially to the manipulator head, a spindle nut of a driven threaded spindle mounted on the bearing flanges being disposed in the base carriage, a support carriage mounted on the base carriage and capable of traveling in a direction of a diagonal of the manipulator head and carrying, substantially in the center thereof, the axially arranged drive motor for the grinding tool, a base plate secured in parallel with the support flange to the support carriage via a pipe sleeve extending concentrically to a shaft of the motor means and passing through the other support flange free of connections for feed lines, the grinding tool comprising a driven abrasive belt disposed on the base plate and guided over three guide rollers, respectively, formed as a drive roller, a tensioning roller and a grinding roller having the fine feed, and a retaining clip secured to the base plate, the retaining clip extending over and beyond the grinding tool to the axis of the manipulator head and having connections thereon for the feed lines.

In such a constructed manipulator head, initial assurance is afforded that the grinding device can be driven readily into the respective grinding position with the aid of the base carriage and the support carriage after the manipulator head has been fixed in the pipe or pipeline. Due to the arrangement of the grinding device outside the two support flanges and due to the arrangement of connections for the feed lines at both ends of the manipulator head, assurance is further provided that the manipulator head, also when the pipelines are traversed on only one side thereof at pipe elbows, can be so positioned that both support flanges are always located in a rectilinear section of the pipeline. The use of a grinding belt as a grinding tool proper, moreover, results in the high grinding power. In this regard, the arrangement of the grinding device outside the two support flanges assures a simple and rapid exchange or replacement of the grinding belt.

For the drive of the base carriage axially traversible between the support flanges, it has been found to be advantageous also, in accordance with another feature of the invention, to have the threaded spindle drivingly connected to an electric motor via a serrated belt.

For the drive of the support carriage in the direction of a diagonal of the manipulator head, it has been found to be advantageous, on the other hand, in accordance with yet another feature of the invention, to provided the support carriage with a lifting or thrust piston drive. In this regard, it is recommended to arrange a sensing roller, in direction of the diagonal, at the outer periphery of the base plate carrying the grinding device, the drive of the support carriage being stopped by means of the sensing roller when the latter comes into contact with the pipe wall.

The fine-feed of the grinding belt occurs in the respective grinding position, as mentioned hereinbefore, with the aid of a grinding roller. This is mounted, in accordance with an added feature of the invention, on a carrying arm engaging with a spindle nut guided on a threaded spindle. With regard to achieving the most compact construction possible of the driving device for the fine feed, the threaded spindle is coupled, via a serrated-belt drive and an angle drive, with the feeding device mounted on the base plate.

Furthermore, in the interest of attaining the most compact construction possible of the driving device for the grinding belt, in accordance with the invention, the drive roller of the grinding belt engages, via a serrated belt, with the pinion of the drive motor mounted in the base plate. To match the guide path of the grinding belt to the position of the grinding roller provided by the respective fine feed, the tensioning roller is, moreover, pivotally and adjustably mounted in a fork-shaped holder which, in turn, is spring-loadedly arranged by means of two guide bolts in a guide fastened to the base plate.

To simplify the construction of the grinding device and to facilitate the grinding-belt exchange, in accordance with an additional feature of the invention, the rollers of the grinding belt are arranged on a separate carrier plate, in turn, secured via spacer sleeves to the base plate.

In this regard, in accordance with yet another feature of the invention, the guide rollers with the grinding belt are arranged on a side of a carrier plate facing towards the support plate, the carrier plate being secured to the base plate in spaced relationship therewith, and the spring-loaded guide members of the tensioning roller as well as the feeding device for the grinding roller are arranged on a side of the carrier plate facing away from the support plate.

In accordance with a further feature of the invention, for the purpose of matching the manipulator head and, accordingly, the grinding device, as well, to different pipe diameters, the base plate provided with the support plate has a plurality of fixing points disposed in staggered arrangement transversely to the manipulator head for fixing the spacer sleeves of the carrier plate whereby, for equalizing varying spacings between the pinion of the drive motor fixedly disposed in the base plate and the drive roller of the grinding belt, the serrated belt in engagement with the drive roller of the grinding belt extends over a tensioning roller which is displaceably mounted in the base plate.

As mentioned hereinbefore, the manipulator head is provided both at one end thereof as well as at the other end thereof with connections for the feed lines. The possibility is thereby afforded of driving the manipulator head both backwards as well as forwards in a pipeline. Whereas the connections at the one end of the manipulator head are provided at a support flange, the connections at the other end of the manipulator head are provided at the aforementioned retaining clip.

In accordance with concomitant features of the invention, both connections for the feed lines disposed on the retaining clip and the connections disposed on the one support flange are, in turn, mutually connected electrically, and/or pneumatically via T-branches.

Other features which are considered as characteristic for the invention are set forth in the appended claims.

Although the invention is illustrated and described herein as embodied in a manipulator head with grinding device for pipes or pipelines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
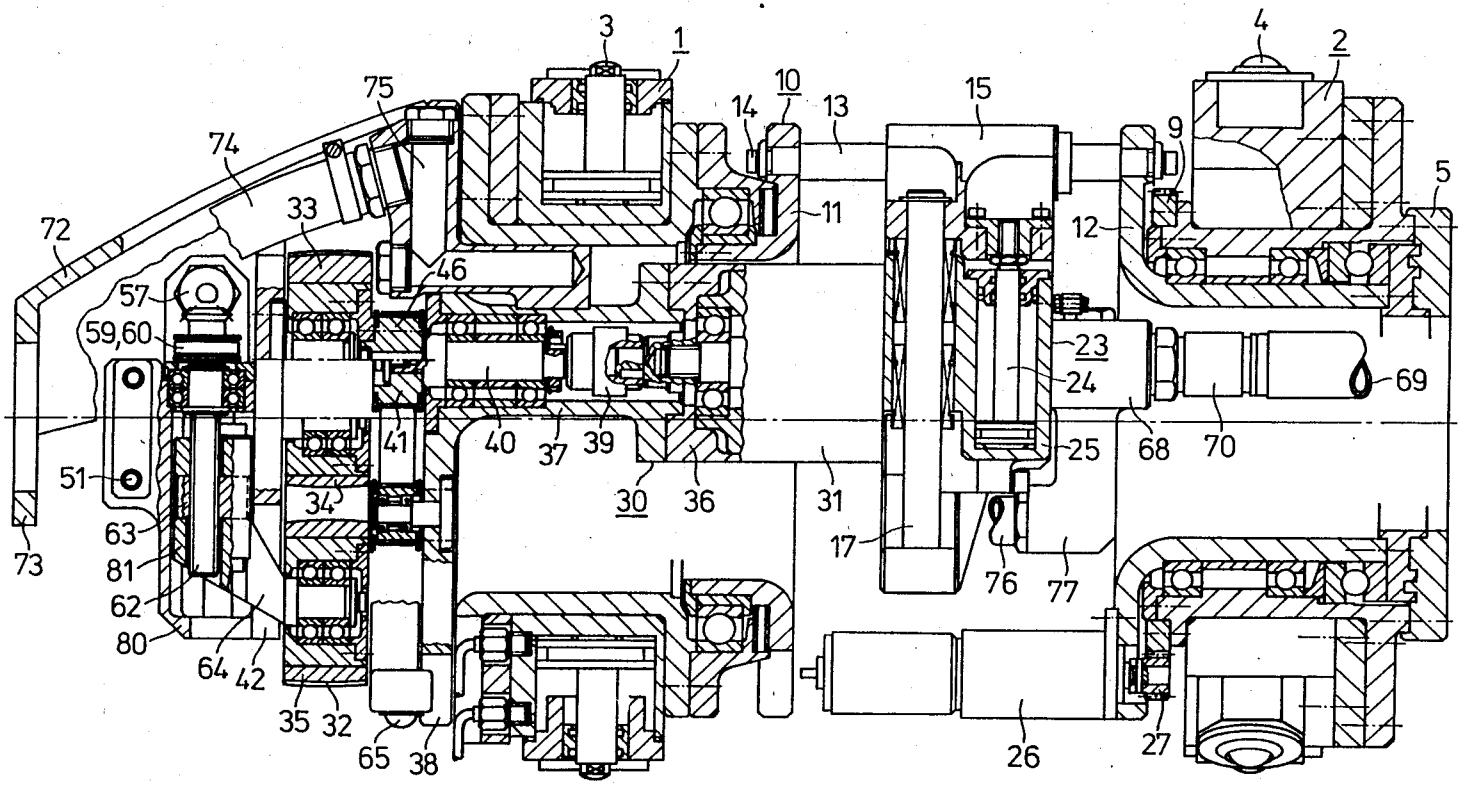
FIG. 1 is a longitudinal sectional view of a manipulator head for pipes or pipelines according to the invention, taken along the line I—I in FIG. 3.
Figure 2:
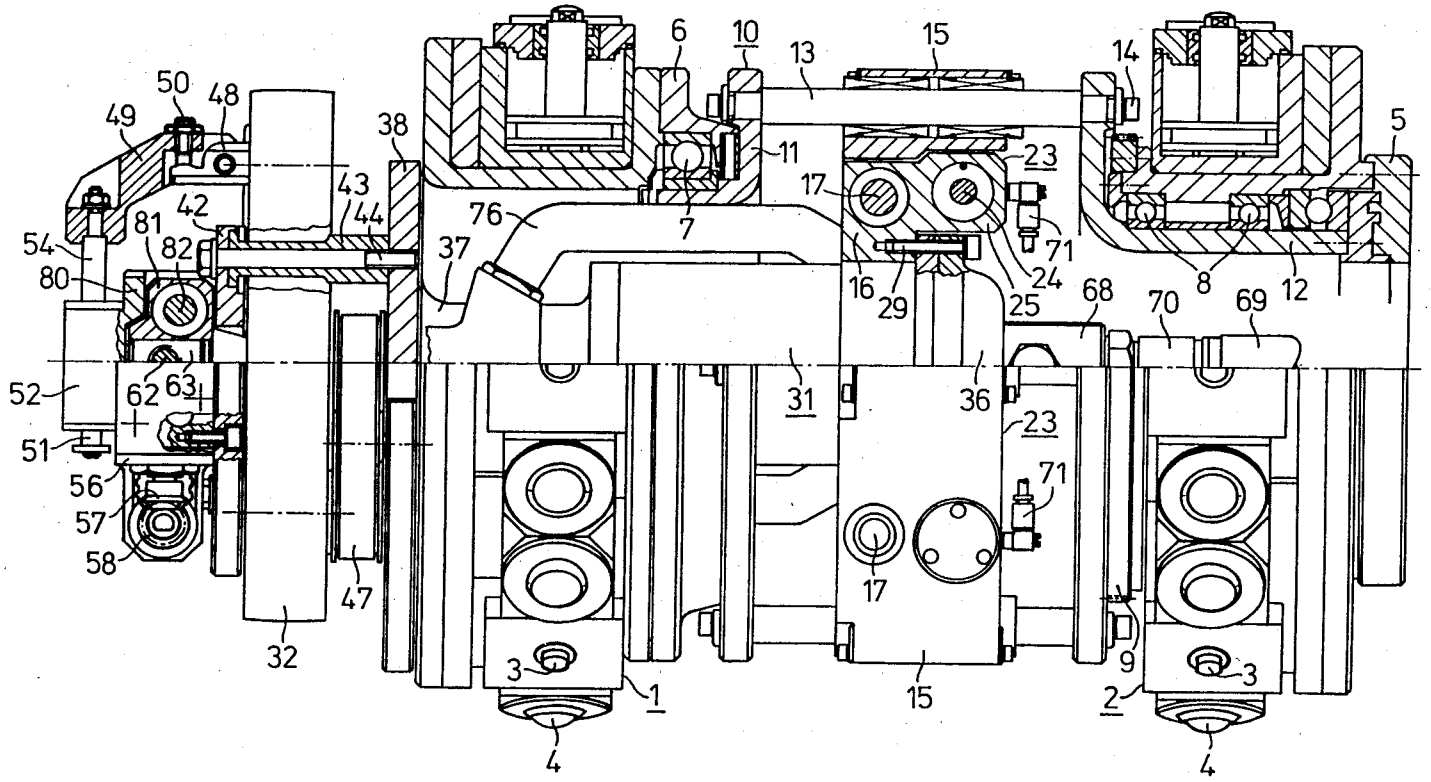
FIG. 2 is a half side elevational view and a half-sectional view of FIG. 1, the half-sectional view being taken along the line II—II in FIG. 3.
Figure 3:
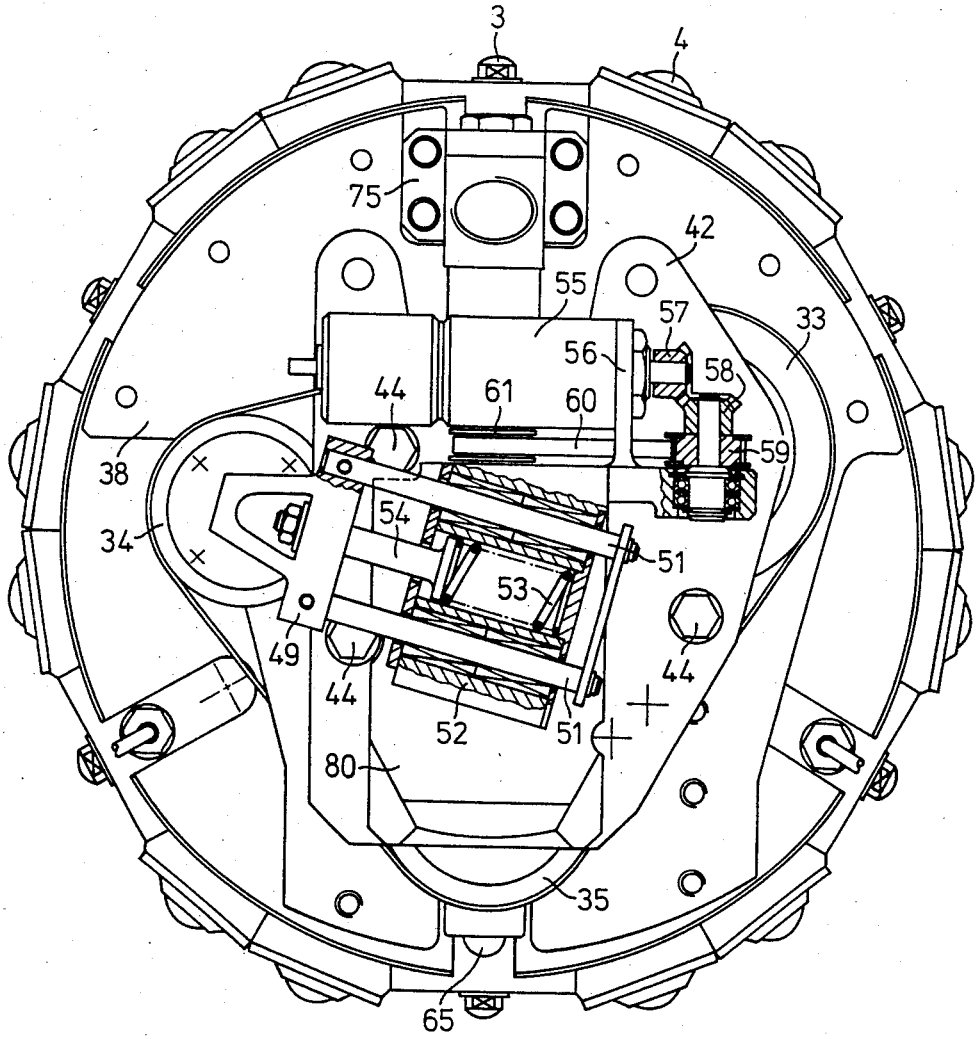
FIG. 3 is a cross-sectional view of FIG. 1 taken along the line III—III in the latter figure.
Figure 4:
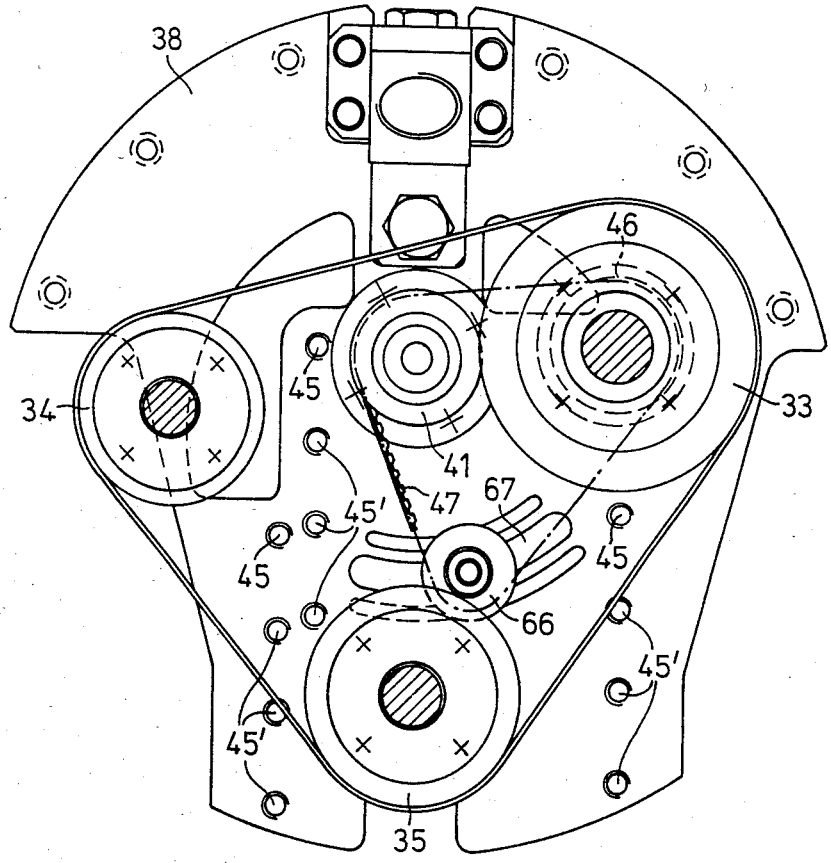
FIG. 4 is a cross-sectional view of FIG. 1 taken along the line IV—IV.

Referring now to the drawing and first, particularly, to FIGS. 1 and 2 thereof, there is shown a manipulator head which offers an advance in the art over the heretofore known construction disclosed in the published non-prosecuted application for a European patent identified as EP-OS No. 0 061 078. The manipulator head of the invention is made up of the following essential building blocks:

1. Support flanges 1 and 2 which, in accordance with conventional constructions, are provided with radially extensible clamping devices 3 and with guide elements 4 for rollingly guiding the manipulator head;

2. A frame 10 firmly connecting the two support flanges 1 and 2 to one another, and rotatably mounted in the flanges 1 and 2; and 3. A grinding device 30 mounted in the frame 10 so as to be axially and radially displaceable, and carrying an endless abrasive or sanding belt as a grinding tool proper.

A supporting plate 5 is connected to the support flange 2 and is provided with non-illustrated connectors or junctions for supply lines of various drive units.

The frame 10 rotatably mounted in the support flange 1 and 2 is formed of two bearing flanges 11 and 12 and three spacer sleeves 13 with appertaining clamping bolts 14. The bearing flange 11 is mounted through the intermediary of ball bearings 7 in a counterflange 6 of the support flange 1, while the bearing flange 12 is mounted by means of the ball bearings 7 directly in the support flange 2. Both bearing flanges 11 and 12 are spaced apart by means of the spacer sleeves 13, the clamping bolts 14 extending through the spacer sleeves 13.

Figure 5:
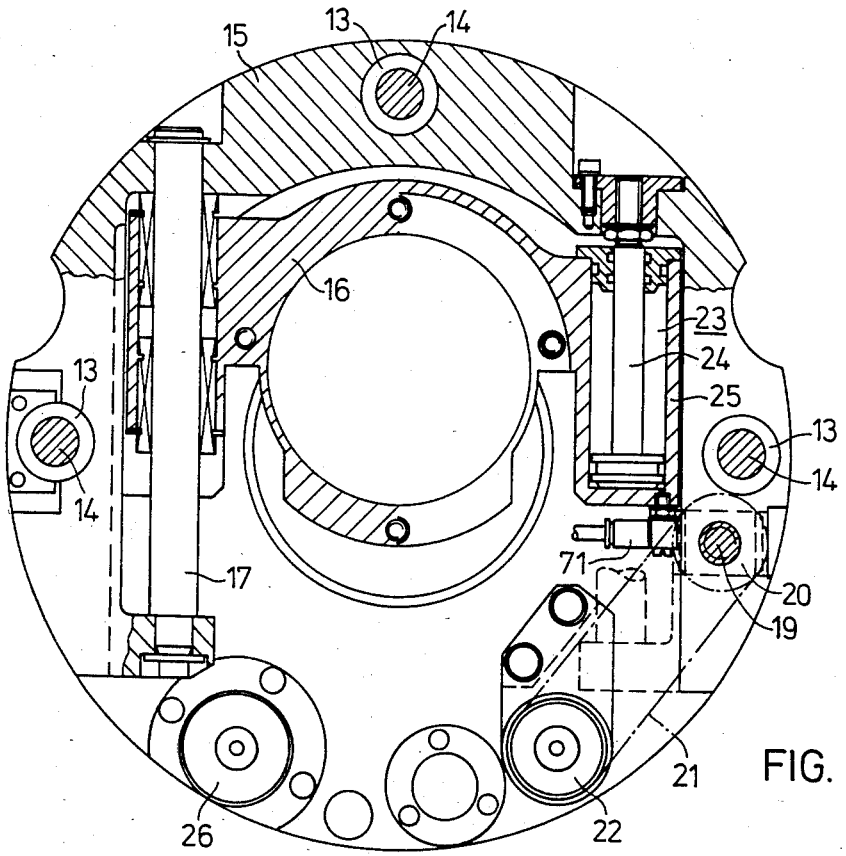
FIG. 5 is a cross-sectional view of FIG. 1 taken along the line V—V.
Figure 6:
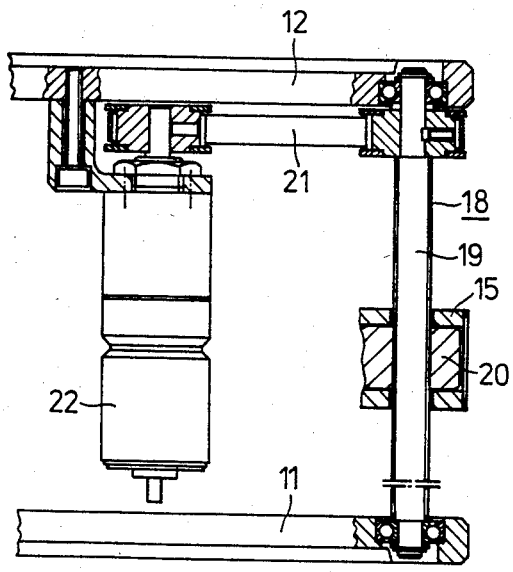
FIG. 6 is a fragmentary sectional view of FIG. 5 taken along the line VI—VI.

Referring to FIG. 5, a base slide or carriage 15 is arranged between the bearing flanges 11 and 12 and is guided on the spacer sleeve 13. This base slide 15 is somewhat ring-shaped and downwardly open, and carries a support slide or carriage 16 which is guided by two guide bolts 17. A spindle traveling nut drive 18, as shown in FIG. 6 is provided for axially displacing the base slide 15 along the spacer sleeves 13, the threaded spindle 19 of the drive 18 being mounted in the bearing flanges 11 and 12 whereas the traveling or spindle nut 20 of the drive 18 is mounted in the base slide 15. The threaded spindle 19 is driven via a toothed, serrated or V-belt 21 by an electric motor 22 which is fastened to the bearing flange 12.

The support slide 16 is disposed so as to be displaceable transversely to the base slide 15 and, thereby, along a diagonal of the manipulator head. For this purpose, two thrust or lifting-piston drives 23 are provided, which are connected between the base slide 15 and the support slide 16. The lifting pistons 24 of these drives are fixed to the base slide 15, while the lifting cylinders 25 in which the pistons 24 travel are fastened to the support slide 16.

As shown in FIG. 1, a revolving motor 26 is provided, moreover, for rotating the frame 10 and, accordingly, the base slide 15 and the support slide 16, as well, around the manipulator axis. The revolving motor 26 is fastened to the bearing flange 12 and carries a pinion 27 which meshes with a ring or crown gear 9 fastened to the support flange 2.

The guiding device 30, as shown in FIGS. 1 to 4, is made up primarily of a drive motor 31 in the form of an air turbine, an abrasive or grinding belt 32 with three idlers or guide or tension rollers 33, 34 and 35, and auxiliary devices for tensioning the abrasive belt 32, for finely adjusting the radial setting of the abrasive belt 32 and for matching the fine adjustment to different pipe diameters.

The drive motor 31 has a housing 36 with which it is fixed by means of screws 29 centrally in the support slide 16. A base plate 38 on which the guide rollers 33, 34 and 35 of the abrasive belt 32 and the auxiliary devices are arranged is fastened to the housing 36 via a tube sleeve or socket 37. The latter protrudes through the guide flange 1 so that the base plate 38 is disposed on the outside of the support flange 1 and parallel thereto. In the tube sleeve 37 is a coupling 39 for connecting the drive motor 31 to an end of a drive shaft 40 which carries a pinion 41 at the other end thereof.

The abrasive belt 32 provided as the guiding tool proper is guided via three guide rollers 33, 34 and 35 arranged at the corners of an imaginary triangle. The guide roller 33 serves as a drive roller, the guide roller 34 as an idler or tension roller, and the guide roller 35 as a grinding roller. These guide rollers 33, 34 and 35 are mounted on a separate support plate 42 which is fastened via three spacer sleeves 43 to the base plate 38, parallel to the latter. The fastening is effected with fitted bolts or screws 44 which engage in corresponding threaded bores 45 (FIG. 4) formed in the base plate 38.

The guide rollers 33, 34 and 35 of the abrasive belt 32 are located on the side of the support plate 42 facing towards the support flange 1. The drive roller 33 is in engagement, via a flanged gear 46 and via a V or toothed belt 47, with the pinion 41. The guide or tension roller 34 of the abrasive belt 32 is located at one end of a double-armed or bell crank lever 48 which is mounted in a fork-shaped holder 49. An adjustable stop 50 forms an abutment or stop point in the holder 49 for the other end of the lever 48. With the aid of the stop 50, the steering stability of the abrasive belt 32 on the slightly spherically-shaped or cambered rollers 32, 33 and 34 is adjusted. The holder 49 is displaceable with spring loading or force parallel to the support plate 42, for which purpose, two guide bolts 51, a guide housing 52 and a thrust member 54 acted upon by a compression spring 53 are provided. The guide housing 52 is part of a housing 80 which is fastened to the side of the support plate 42 facing away from the manipulator head.

The grinding roller 35 with which the abrasive belt 32 is pressed against the respective grinding location, is provided with a fine adjustment or feed system formed of an electric motor which serves as a feed drive, an angle drive, a toothed or V-belt drive and a traveling nut-spindle drive. The electric motor 55 and the drives are located on a frame 56 which is seated on the housing 80 and, in fact, on the side thereof facing away from the manipulator head. The fine feed of the grinding roller 35 occurs in direction of the diagonal displacement of the support carriage 16 in the frame 10. For this purpose, the output or power take-off shaft of the angle drive formed of bevel gears 57 and 58 extends parallel to the guide bolts 17. A gear 59 is coupled with the bevel gear 58 and drives a threaded spindle 62 via a toothed or V-belt 60 and an opposing gear 61. The threaded spindle 62 is mounted in the housing 80 and meshes with a traveling nut 63. The traveling nut 63 is coupled with a guide member 81 which, in turn, is provided with a carrying arm 64 for the grinding roller 35 passing through the support plate 42. The guide member 81 slides along a pair of guide bolts 82 which are disposed at both sides of the threaded spindle 62 in the housing 80.

To limit the radial feed of the support carriage 16, a feeler or sensing roller 65 is provided at the periphery of the base plate 38 in displacement direction of the grinding roller 35.

To match the grinding device to varying pipe diameters, the support plate 42 can be fastened to the base plate 38 at varying positions. For this purpose, a plurality of threaded bores 45' for each tight-fitted screw 44 are arranged staggered transversely to the manipulator head. In order to equalize or compensate for varying spacings between the drive roller 33 fixedly associated with the base plate 38 and the pinion 41, the toothed or V-belt 47 is passed over a tension roller 66 which, in turn, is displaceably fastened in the base plate 38 on a circular arc 67 coaxially with the pinion 41.

To supply energy to the various drive units of the manipulator head, feed lines are connected to the manipulator head which are fed to the manipulator head advantageously in the longitudinal axis thereof. These supply lines are continued within the manipulator head, plug connections being advantageously employed, in fact, both for the electrical as well as for the pneumatic or hydraulic lines. In FIG. 1, for example, an air connection 68 for the drive motor 31 is represented, to which a hose 69 is connected by means of a quick-acting coupling 70. In FIG. 2, compressed air connections 71 for the lifting-piston drive 23 are shown. All of the feed lines provided within the manipulator head terminate at otherwise non-illustrated plug devices which are fastened to the supporting plate 5.

In order to be able also to drive the manipulator head backwards into a pipeline, a second connecting system is provided for the feed lines. In this regard, a retaining clip 72 is fastened to the base plate 38, as shown in FIG. 1, and extends over the grinding tool per se to reach the axis of the manipulator head. At a flange-shaped free end 73 of the retaining clip 72, otherwise non-illustrated plug connections for the feed lines are provided. From there, the feed lines extend, as T-shaped branches, to the connecting points themselves at the respective drive unit. Such a T-shaped branch for the drive motor 31, in the case at hand, is formed of an air hose 74, an air connection 75, another air hose 76 and a branch member 77 per se.

The foregoing is a description corresponding, in substance, to German application P No. 34 47 551.6, dated Dec. 21, 1984, International priority of which is being claimed for the instant application, and which is hereby made part of this application. Any material discrepancies between the foregoing specification and the specification of the aforementioned corresponding German application are to be resolved in favor of the latter.

There is claimed:

1. Manipulator head for remote-controlled positioning and operation of a grinding device within a pipe, comprising two support flanges having radially outwardly drivable clamping devices and radially disposed guide elements for rollingly extending the manipulator head, a frame rotatably mounted in said support flanges and rigidly connecting said two support flanges axially, a grinding device fastened to said frame, said grinding device including a grinding tool, a drive and bearing member for said grinding tool, a drive device for axially adjusting said grinding device, and a feed drive device for radially fine-feeding said grinding tool, motor means for rotating said frame relative to said support flanges, connections for feed lines of said drive devices disposed on only one of said support flanges, said frame being formed of two bearing flanges clamped together by means of spacer sleeves and clamping bolts extending through said spacer sleeves, a base carriage guided on said spacer sleeves so as to travel axially to the manipulator head, a spindle nut of a driven threaded spindle mounted on said bearing flanges being disposed in said base carriage, a support carriage mounted on said base carriage and carrying, substantially in the center thereof, said axially arranged drive motor for said grinding tool, a base plate secured in parallel with said support flange to said support carriage via a pipe sleeve extending concentrically to a shaft of said motor means and passing through the other support flange free of connections for feed lines, said grinding tool comprising a driven abrasive belt disposed on said base plate and guided over three guide rollers, respectively, formed as a drive roller, a tensioning roller and a grinding roller having said fine feed, and a retaining clip secured to said base plate, said retaining clip extending over and beyond said grinding tool to the axis of the manipulator head and having connections thereon for said feed lines.

2. Manipulator head according to claim 1, wherein said threaded spindle is drivingly connected to an electric motor via a serrated belt.

3. Manipulator head according to claim 1, wherein said support carriage has a lifting piston drive supported on said base carriage.

4. Manipulator head according to claim 1, wherein said drive roller for said grinding belt engages via a serrated belt with a pinion of said drive motor mounted in said base plate.

5. Manipulator head according to claim 1, wherein said tensioning roller is mounted pivotally and adjustably in a fork-shaped holder disposed, in turn, by means of two guide bolts, in a spring-loaded arrangement in a guide secured to said base plate.

6. Manipulator head according to claim 1, wherein said grinding roller is mounted on a carrying arm engaging with a spindle nut guidable along a threaded spindle, said threaded spindle being coupled, via a serrated-belt drive and an angle drive, with said feeding device mounted on said base plate.

7. Manipulator head according to claim 1, wherein said guide rollers of said grinding belt are arranged on a separate carrier plate, in turn, secured via spacer sleeves to said base plate.

8. Manipulator head according to claim 5, wherein said guide rollers with said grinding belt are arranged on a side of a carrier plate facing towards said support plate, said carrier plate being secured to said base plate in spaced relationship therewith, and the spring-loaded guide members of said tensioning roller as well as said feeding device for said grinding roller are arranged on a side of said carrier plate facing away from said support plate.

9. Manipulator head according to claim 7, wherein said base plate has a plurality of fixing points disposed in staggered arrangement transversely to the manipulator head for fixing said carrier plate thereon, said serrated belt in engagement with said said drive roller of said grinding belt being guided over a tensioning roller displaceably mounted in said base plate.

10. Manipulator head according to claim 1, wherein said connections for said feed lines disposed on said retaining clip and said connections disposed on said one support flange are, in turn, mutually connected via T-branches.

11. Manipulator head according to claim 10, wherein the mutual connection of said connections, respectively, on said retaining clip and on said one support flange is electrical.

12. Manipulator head according to claim 11 wherein the mutual connection of said connections, respectively, on said retaining clip and on said one support flange is pneumatic.

13. Manipulator head according to claim 1, including a sensing roller disposed at the outer periphery of said base plate in the direction of the diagonal of the manipulator head.

* * * * *